United States Patent [19]

Heimo

[11] 4,196,535

[45] Apr. 8, 1980

[54] HOLDING ARRANGEMENT FOR TRANSLUCENT PICTURES

[76] Inventor: Ernest Heimo, Ch. De-Beau-Rivage 10, CH-1006 Lausanne, Switzerland

[21] Appl. No.: 860,769

[22] Filed: Dec. 15, 1977

[30] Foreign Application Priority Data

Dec. 24, 1976 [DE] Fed. Rep. of Germany ... 7640586[U]

[51] Int. Cl.[2] ..... G09F 1/12; G09F 3/02

[52] U.S. Cl. ..... 40/156; 40/10 D; 40/19

[58] Field of Search ..... 40/156, 152, 152.1, 40/158 R, 10 D, 10 R, 554, 19

[56] References Cited

U.S. PATENT DOCUMENTS

| | | | |
|---|---|---|---|
| 1,742,378 | 1/1930 | Boese | 40/156 |
| 3,456,106 | 7/1969 | Gluschkin | 40/554 |
| 3,596,391 | 8/1971 | Knight | 40/152 |
| 3,694,947 | 10/1972 | Mukai | 40/152 |
| 3,928,930 | 12/1975 | Attwood | 40/607 |
| 4,019,269 | 4/1977 | Vix | 40/152 X |

FOREIGN PATENT DOCUMENTS

| | | | |
|---|---|---|---|
| 496472 | 4/1929 | Fed. Rep. of Germany | 40/19 |

*Primary Examiner*—John F. Pitrelli
*Attorney, Agent, or Firm*—Max Fogiel

[57] ABSTRACT

A holding arrangement for translucent pictures in which a curved transparent pane has fitted thereinto a foil. The foil adheres to the pane and fits into the curvature of the pane. The foil is made of elastic transparent material, and pictures are arranged between the foil and the pane. An auxiliary foil may be placed into the first-mentioned foil, and may be made also of an elastic translucent material. A further foil may also be placed between the pane and the first-mentioned foil, and may also be made of translucent material. This further foil of translucent material may be moreover located between the first-mentioned foil of elastic transparent material and the pictures. The pane, on two facing sides running parallel to the longitudinal axis of the curvature, has crimps directed towards the curvature. The crimps engage the foil of transparent or translucent material with two facing sides. Two facing sides of the curved transparent pane may be bent together and joined, and the bend may be parallel to the curvatures.

1 Claim, 11 Drawing Figures

FIG. 4a
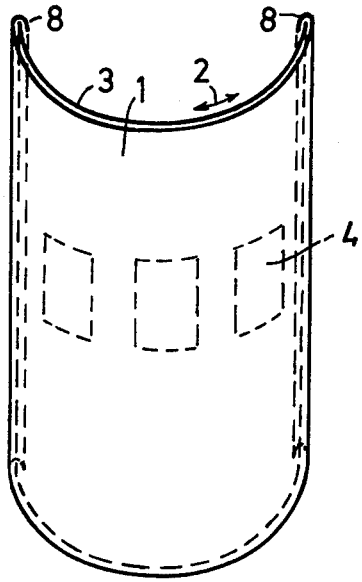
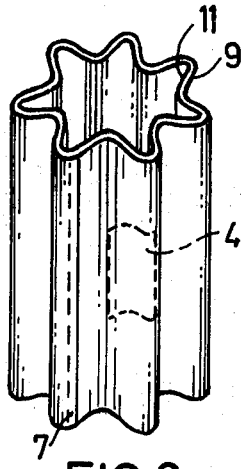
FIG. 6
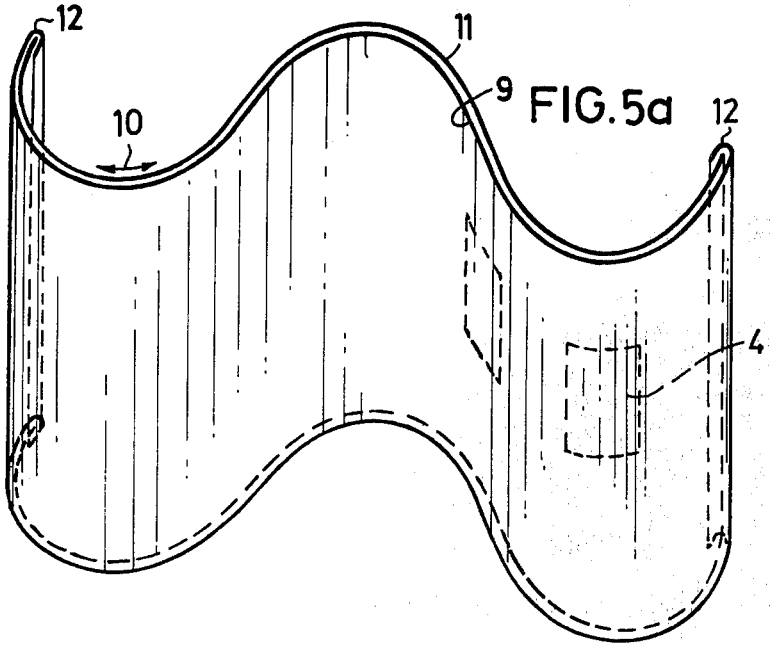
FIG. 5a

HOLDING ARRANGEMENT FOR TRANSLUCENT PICTURES

BACKGROUND OF THE INVENTION

The present invention relates to a holding arrangement for translucent pictures.

Photographs are being copied to an increased extent on material, particularly translucent synthetic foil. Hence the pictures are translucent and can be inspected not only when light falls on them, but when light passes through them.

It is the object of the present invention to provide a holder for such translucent pictures in which the pictures can remain permanently and can yet be replaced.

Another object of the present invention is to provide a holding arrangement of the foregoing character which is substantially simple in construction and may be economically fabricated.

A further object of the present invention is to provide an arrangement, as described, which does not require special skills for the user to apply, and which has a substantially long service life.

SUMMARY OF THE INVENTION

The objects of the present invention are achieved by providing a holding arrangement for translucent pictures which comprises a curved transparent pane and a foil that fits into the curvature and is adjacent to the pane, of a transparent material, with the translucent pictures located between the pane and the foil.

The pane may be made of any transparent material. It is advantageous to use a transparent pane of an elastic synthetic which is flexible and in which two facing sides can be bent together and joined. With this arrangement, the pane of transparent material has the form of a lampshade and can be used as such.

If two facing sides of the curved transparent pane are not bent together and not joined, it is practical for preventing sliding off of the elastic transparent foil conforming with the pane, to provide the pane on two facing sides running parallel with the lengthwise axis of the curvature, with crimps directed into the curvature. These crimps engage the foil of an elastic transparent or translucent material and/or foil of an elastic translucent material with two facing sides.

This pane must not necessarily be of clear transparent material. It may be colored or tinted or translucent if it is ensured that the observer can recognize what was shown on the pictures.

With lamps of any kind, the incandescent bulb, regardless of its shape and type, forms in the lamp a bright point or a bright line which can be disturbing during viewing the pictures. For this reason, a further embodiment provides that in the foil of transparent material, a foil of an elastic translucent material be placed. It is also possible to place between pane and the foil of elastic transparent material a foil of translucent material, or, for reasons of material saving, a foil fitting into the curvature which adheres to the pane and is made of an elastic translucent material. As a result, the bright point line produced by the incandescent lightbulb is blurred and does not interfere with the observation of the pictures. Of course the inserted foil or the additional inserted foil must be made of a translucent material which blurs the point/line produced by the incandescent bulb, but is still so brightly translucent that the pictures are perfectly seen under translucent light.

Other improvements of the present invention are shown in the dependent claims and in the description of the figures. It is noted that all individual improvements and all combinations of improvements are essential to the invention.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1*a* to 5*a* are perspective views of the embodiments shown in FIGS. 1 to 5, respectively. FIG. 6 shows a perspective view of a multiply-curved arrangement with joined ends.

DESCRIPTION OF THE PREFERRED EMBODIMENTS

Figure 1:
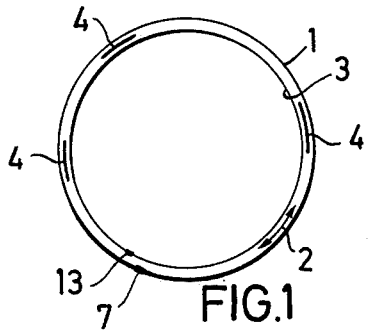
FIG. 1 is a plan view and shows the arrangement between the curved pane, foil and pictures.
Figure 2:
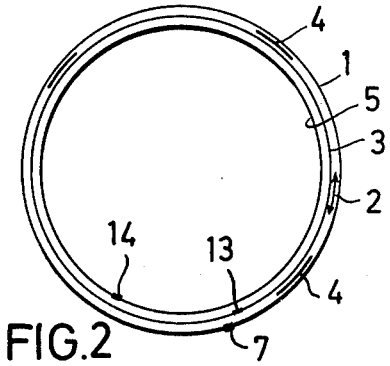
FIG. 2 is a plan view of another embodiment of FIG. 1.
Figure 3:
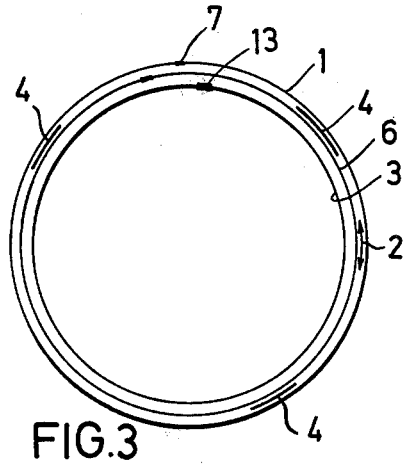
FIG. 3 is a plan view of a further embodiment of the arrangement of FIG. 2.

In FIGS. 1 to 3, the pane 1 of transparent material particularly clear transparent synthetic material, is bent cylindrically. Two facing sides are joined at seam 7. In this foil 1 of transparent material, foil 3 of an elastic transparent material is fitted. Two facing sides of foil 3 contact each other or overlap at seam 13. Foil 3 adheres to pane 1. Translucent pictures 4 are located between pane 1 and foil 3. This picture 4 can be inserted from above or below between the pane 1 and the foil. Even though these translucent pictures are held between foil 3 and pane 1 because foil 3 adheres closely to the pane 1, they can be replaced without special effort.

In the embodiment of FIG. 2, there is fitted into foil 3 of transparent material a foil 5 of translucent material. Because of this foil 5 of translucent material, the bright point produced by the incandescent bulb of a lamp or the bright line produced by a neon tube do not bother the observer of the pictures. This foil 5 also must be of an elastic material to ensure that it can be fitted into the foil 3 of transparent material. With circular closed panes 1, two facing sides of foil 5 touch or overlap at seam 14.

In the embodiment of FIG. 3, a foil 6 of a flexible elastic material is placed advantageously between disk 1 and elastic foil 3, and the side of picture 4 facing the foil. With this embodiment, the foil 6 of translucent material need only be flexible. Elasticity is not required because it is held between pane 1 and the elastic foil 3.

Of course, in a further embodiment of the invention it is also possible to make the foil 3 of an elastic translucent material so that the foil 5 or foil 6, are not necessary.

Figure 4:
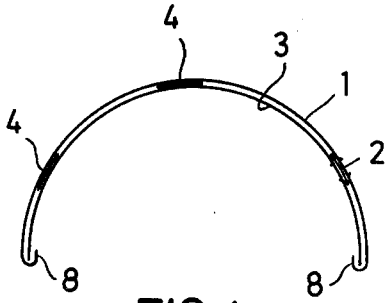
FIG. 4 is a still further embodiment of the arrangement of the present invention.

The embodiment of FIG. 4 shows a semi-circular bent pane 1 into which the foil 3 of elastic material is fitted. To ensure that the foil 3 of elastic material does not slide off, the pane 1 on both facing sides running parallel with curvature 2 has crimps 8 directed into the curvature 2 which engages the elastic foil 3 with the two facing sides.

The curvature 2 of disk 1 is shown in FIGS. 1 to 4 with a double arrow.

Figure 5:
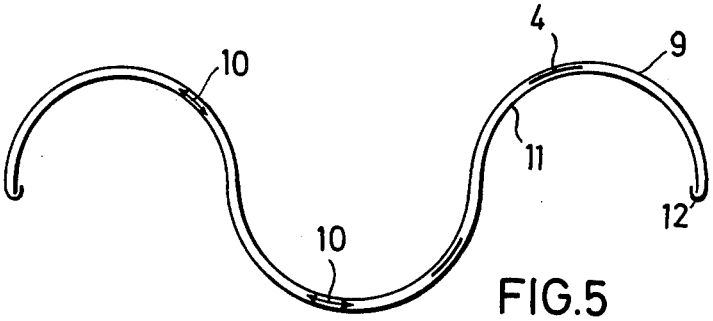
FIG. 5 is a plan view and shows a multiply-curved pane of the present invention.
Figure 1A:
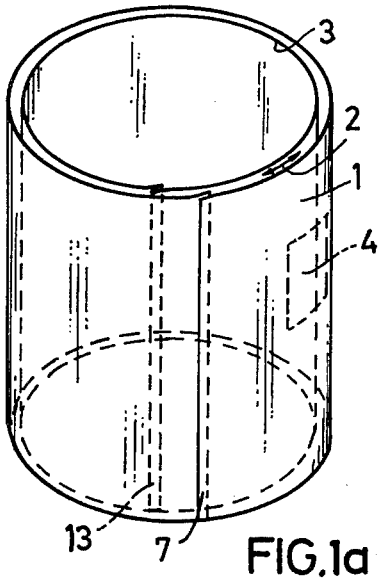
Figure 2A:
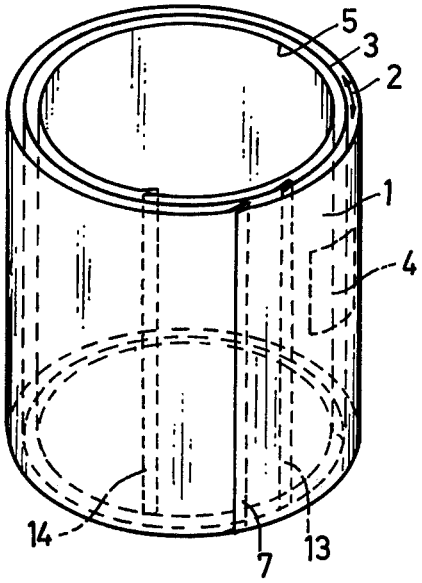
Figure 3A:
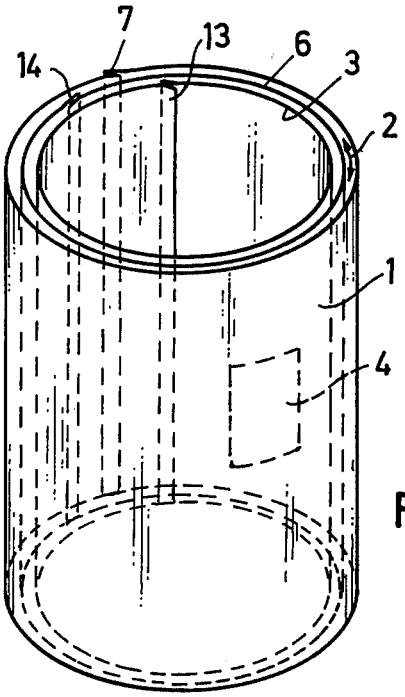

The embodiment of FIG. 5 shows a multiply-curved pane 9. The curvatures 10 are indicated by arrows. At two facing sides which run parallel to curvatures 10, pane 9 has crimps 12 in the same direction. The elastic foil 11 engages these crimps 12 with two facing sides so that it adheres to pane 9 also with this embodiment.

Of course, it is possible to give the curved pane of transparent material another shape if care is taken that a foil can be fitted to the pane and adheres to it so that translucent pictures can be held between pane and foil. For example, the pane may be bent cylindrically or in the form of a truncated cone and form a lampshade. It is also possible to provide cutouts in the disk and the foils.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A holding arrangement for translucent pictures comprising: a curved transparent pane; a foil fitting into a curvature of said pane and adhering to said pane and being of elastic transparent material; pictures arranged between said foil and said pane; said foil being urged to press against said transparent pane by the elastic characteristics of the material of said foil, said pictures being replaceably held free of support means by pressure between said foil and said pane; a second foil of elastic translucent material fitting into said first-mentioned foil; said second foil being urged to press against said first-mentioned foil by the elastic characteristics of the material of said second foil; an auxiliary foil of translucent material located between said pane and said first-mentioned foil; said auxiliary foil of translucent material is located between said first-mentioned foil and said pictures; said pane having a plurality of adjacent curvatures, said foil engaging said crimps at two facing sides extending parallel to said plurality of curvatures; said two facing sides of said pane being bent together and joined, said bend is substantially parallel to said curvature;

said pane has two facing sides extending parallel to a longitudinal axis of said curvature;

and crimps on said pane and directed towards said curvature of said crimps engaging said foil.

* * * * *